US005957782A

United States Patent [19]

Madara

[11] Patent Number: 5,957,782

[45] Date of Patent: Sep. 28, 1999

[54] GOLF PUTTER WITH SIGHT

[76] Inventor: Gerald J. Madara, 29 Highview Rd., South Windsor, Conn. 06074

[21] Appl. No.: 09/020,919

[22] Filed: Feb. 9, 1998

[51] Int. Cl.[6] ..... A63B 69/36

[52] U.S. Cl. ..... 473/226; 473/238

[58] Field of Search ..... 473/404, 241, 473/549, 538, 220, 238, 300, 201, 226, 219; 33/374, 375, 508, 276, 277, 278, 279, 286, 289

[56] References Cited

U.S. PATENT DOCUMENTS

| | | |
|---|---|---|
| 2,919,491 | 1/1960 | Darrell et al. . |
| 3,698,093 | 10/1972 | Marshall . |
| 4,043,562 | 8/1977 | Shillington . |
| 4,179,125 | 12/1979 | Cone et al. . |
| 4,291,883 | 9/1981 | Smart et al. . |
| 4,927,151 | 5/1990 | Ronnick . |
| 5,351,963 | 10/1994 | Baek . |
| 5,415,408 | 5/1995 | Livesay et al. . |
| 5,433,444 | 7/1995 | Chiuminatta et al. . |
| 5,494,290 | 2/1996 | Stefanoski . |

*Primary Examiner*—Sebastiano Passaniti
*Attorney, Agent, or Firm*—David L. Volk

[57] ABSTRACT

A golf putter includes a head, a shaft, and a sighting apparatus attached to the shaft such that a geometric plane containing both a longitudinal axis of the sighting apparatus and a longitudinal axis of the shaft forms a right angle with a face of the head. When the shaft is oriented vertically, and the hole or flag pole is viewable through the sighting apparatus, the face of the head of the golf putter is pointed toward the hole, thus aligning the golf putter for the putt.

6 Claims, 5 Drawing Sheets

GOLF PUTTER WITH SIGHT

BACKGROUND OF THE INVENTION

1. Field of the Invention

The present invention relates to golf equipment, particularly to golf putters.

2. Description of the Related Art

An important requirement of a successful golf putt is proper alignment of the face of the putter head with the hole. This can actually be quite difficult, especially for longer putts. What is needed is a golf club which is easily aligned with the hole on a putting green.

SUMMARY OF THE INVENTION

The golf putter of the present invention includes a head, a shaft, and a sighting apparatus attached to the shaft such that a geometric plane containing both a longitudinal axis of the sighting apparatus and a longitudinal axis of the shaft forms a right angle with a face of the head. When the shaft is oriented vertically, and the hole or flag pole is viewable through the sighting apparatus, the face of the head of the golf putter is pointed toward the hole, thus aligning the golf putter for the putt.

Still further features and advantages will become apparent from the ensuing description and drawings.

DETAILED DESCRIPTION

Figure 1:
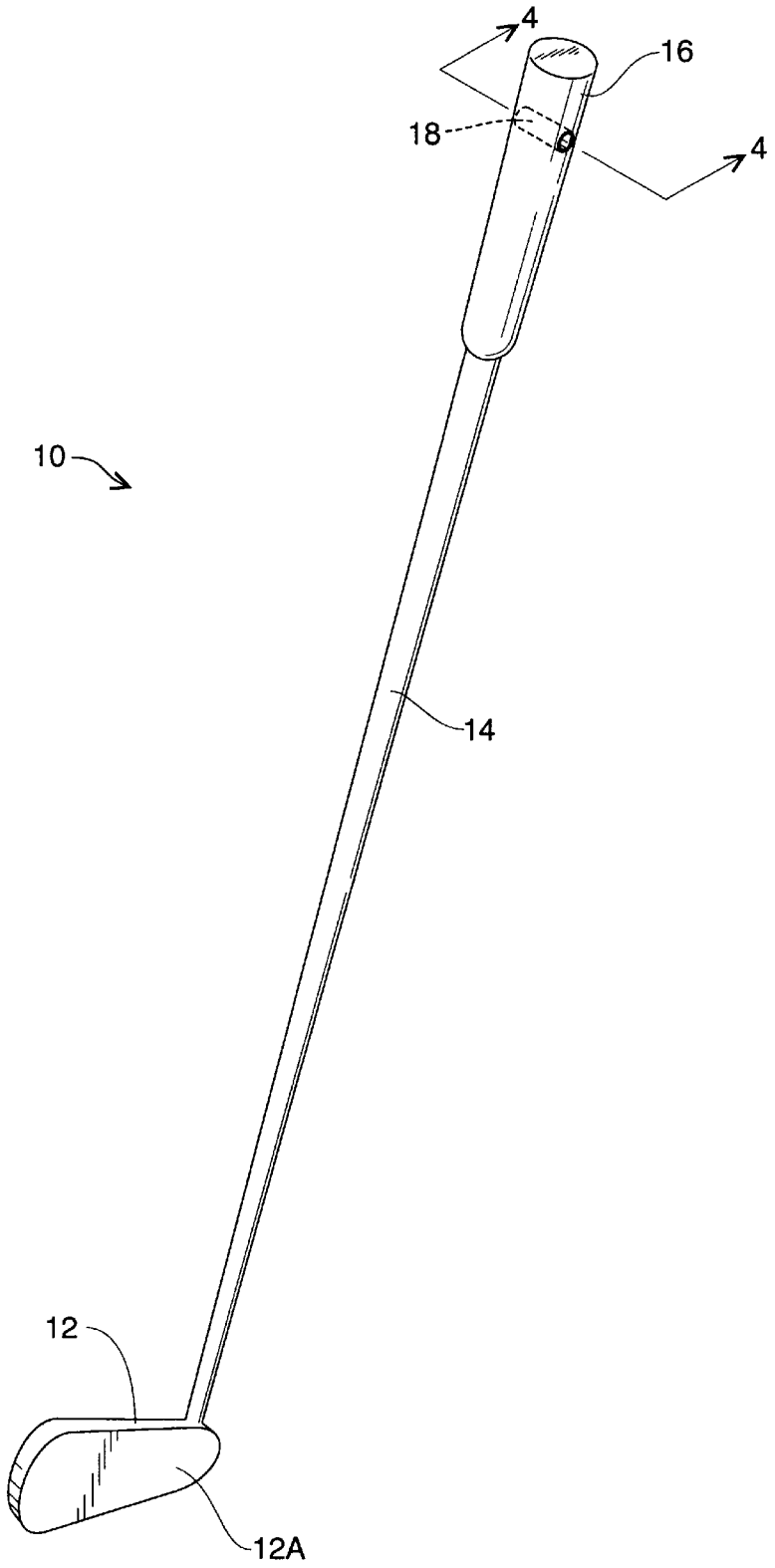
FIG. 1 is a perspective view of a golf putter of the present invention.

FIG. 1 is a perspective view of a golf putter 10 of the present invention. The golf putter 10 comprises a head 12 having a putting face 12A, a shaft 14, and a handle 16 arranged in a conventional manner. A sighting apparatus 18 extends generally transversely through the handle 16.

Figure 2:
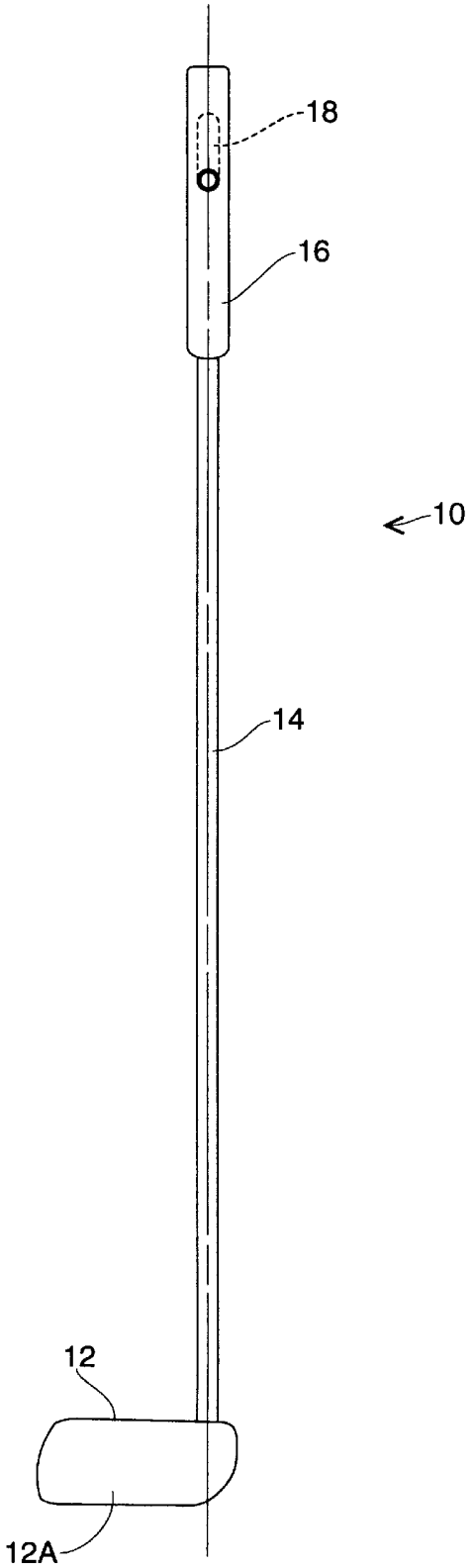
FIG. 2 is a front elevational view of the golf putter.

FIG. 2 is a front elevational view of the golf putter 10. Referring to FIGS. 1 and 2, the sighting apparatus 18 is oriented such that a geometric plane containing both a longitudinal axis of the sighting apparatus 18 and a longitudinal axis of the shaft 14 forms a right angle with the face 12A of the head 12.

Figure 3:
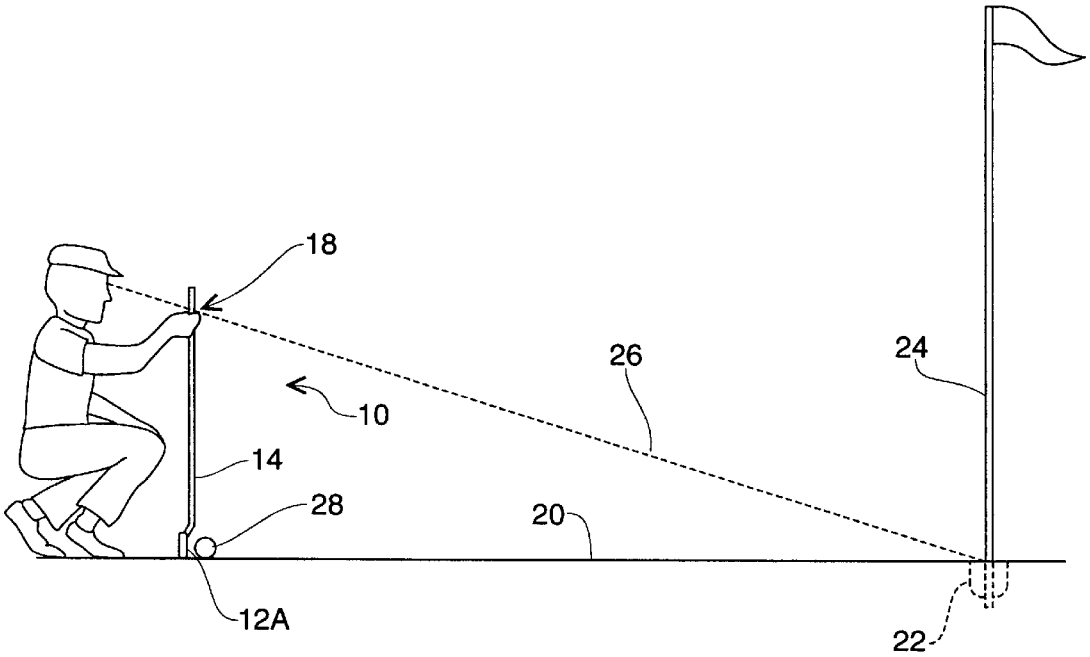
FIG. 3 is an elevational view of a golfer using the golf putter to align a putt.

FIG. 3 is an elevational view of a golfer using the golf putter 10 to align a putt. The golfer aligns the putt by resting the head 12 against the green 20, and orienting the shaft 14 vertically. The golfer then rotates the shaft 14 until the he can view the hole 22 through the sighting apparatus 18. The dotted line 26 represents the line of sight from the golfer's eye, through the sighting apparatus 18 and to the hole 22.

When the golfer can view the hole 22 through the sighting apparatus 18, the face 12A is pointed toward the hole 22.

This is because of the orientation of the sighting apparatus 18 with respect to the face 12A of the head 12, as described above with reference to FIGS. 1 and 2.

Figure 4:
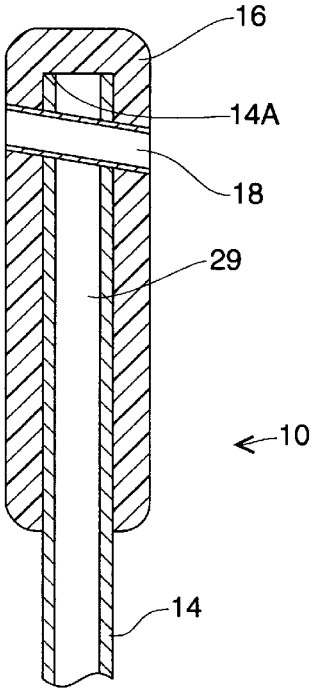
FIG. 4 is a partial cross-sectional view of the golf putter, taken along line 4—4 of FIG. 1.

FIG. 4 is a partial cross-sectional view of the golf putter 10, taken along line 4—4 of FIG. 1. A longitudinal axis of the sighting apparatus 18 as shown, forms a 9.5 degree angle with a horizontal datum when the shaft 14 is oriented vertically. Referring to FIGS. 3 and 4, when the sighting apparatus 18 is oriented as shown, and assuming a height of the sighting apparatus 18 of 34.5 inches above the green 20, the hole 22 is viewable through the sighting apparatus 18 when the golf putter 10 is about 17.2 feet from the hole 22.

Figure 3A:
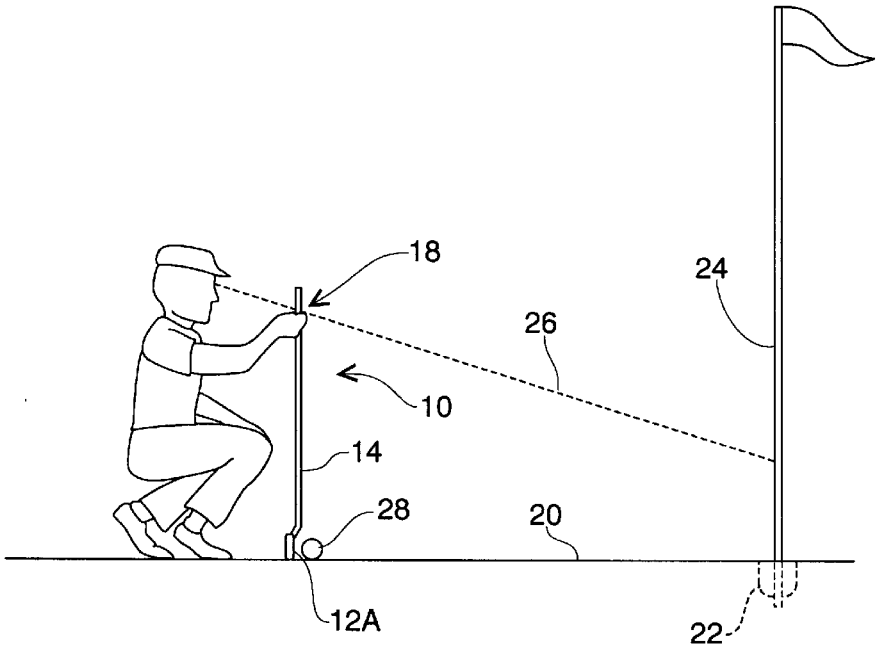

FIG. 3A is another elevational view of a golfer using the golf putter 10 to align a putt. In this figure, the sighting apparatus 18 is aligned to form a 9.5 degree angle with the horizontal datum as described above, and the golf putter 10 is closer than 17.2 feet from the hole 22. In this example, the line of sight 26, if projected would intersect the green 20 beyond the hole 22. If the flag pole 24 is left in the hole 22, the face 12A of the golf putter 10 is pointed toward the hole 22 when the golfer views the pole 24 through the sighting apparatus 18.

If it is desirable to align putts from a distance of greater than about 17.2 feet, the sighting apparatus 18 should be aligned to form an angle of less than 9.5 degrees with the datum, assuming a distance of the sighting apparatus 18 above the green 20 equal to 34.5 inches.

Referring again to FIG. 4, the sighting apparatus 18 extends through the handle 16 and the shaft 14. The sighting apparatus 18 is shown as a tube, but may also be configured like a conventional scope for a rifle, having optical lenses (not shown) on each end.

Figure 5:
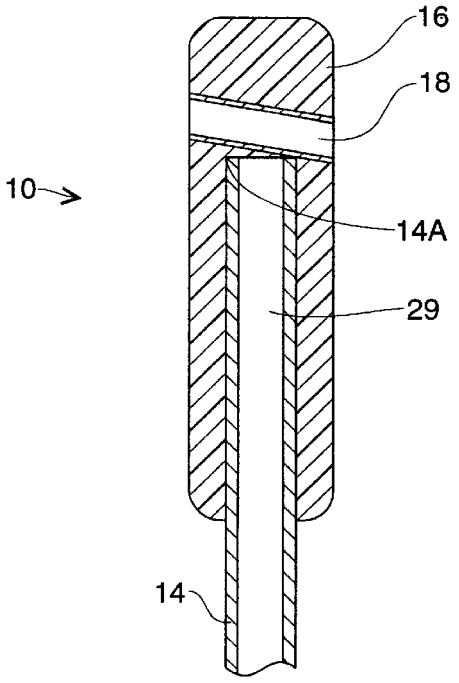
FIG. 5 is a partial cross-sectional view of the golf putter similar to FIG. 4, showing another embodiment.

FIG. 5 is a partial cross-sectional view of the golf putter 10 similar to FIG. 4, showing another embodiment wherein the sighting apparatus 18 ends through the handle 16 beyond a distal end 14A of the shaft 14. In this embodiment, an existing golf putter 10 can be retrofitted by adding the handle 16 incorporating the sighting apparatus 18.

Figure 6:
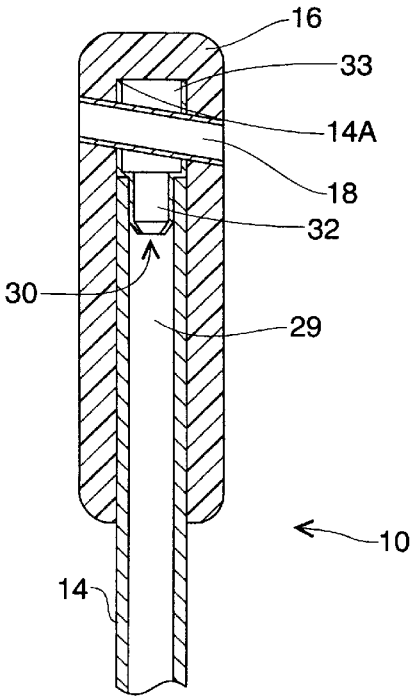
FIG. 6 is a partial cross-sectional view of the golf putter similar to FIG. 4, showing yet another embodiment.

FIG. 6 is a partial cross-sectional view of the golf putter 10 similar to FIG. 4, showing another embodiment wherein an adapter 30 is provided within a longitudinal recess 29 within the handle 16. The adapter 30 includes an insert 32 which is adapted to be received within the shaft 14 through the distal end 14A. An adapter head 33 is positioned beyond the distal end 14A. The sighting apparatus 18 extends generally transversely through the adapter head 33 and through the handle 16. In this embodiment, an existing golf putter 10 can be retrofitted by adding the handle 16 incorporating the adapter 30.

Figure 7:
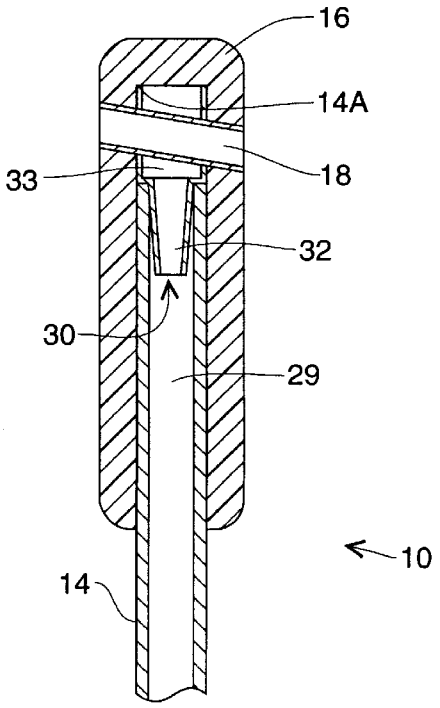
FIG. 7 is a partial cross-sectional view of the golf putter similar to FIG. 4, showing yet another embodiment.

FIG. 7 is a partial cross-sectional view of the golf putter 10 similar to FIG. 6, except that the insert 32 is cone shaped. In this embodiment, the insert 32 is snugly fittable into shafts 14 having a variety of diameters, by varying the degree of penetration of the insert 32 into the shaft 14.

Figure 8:
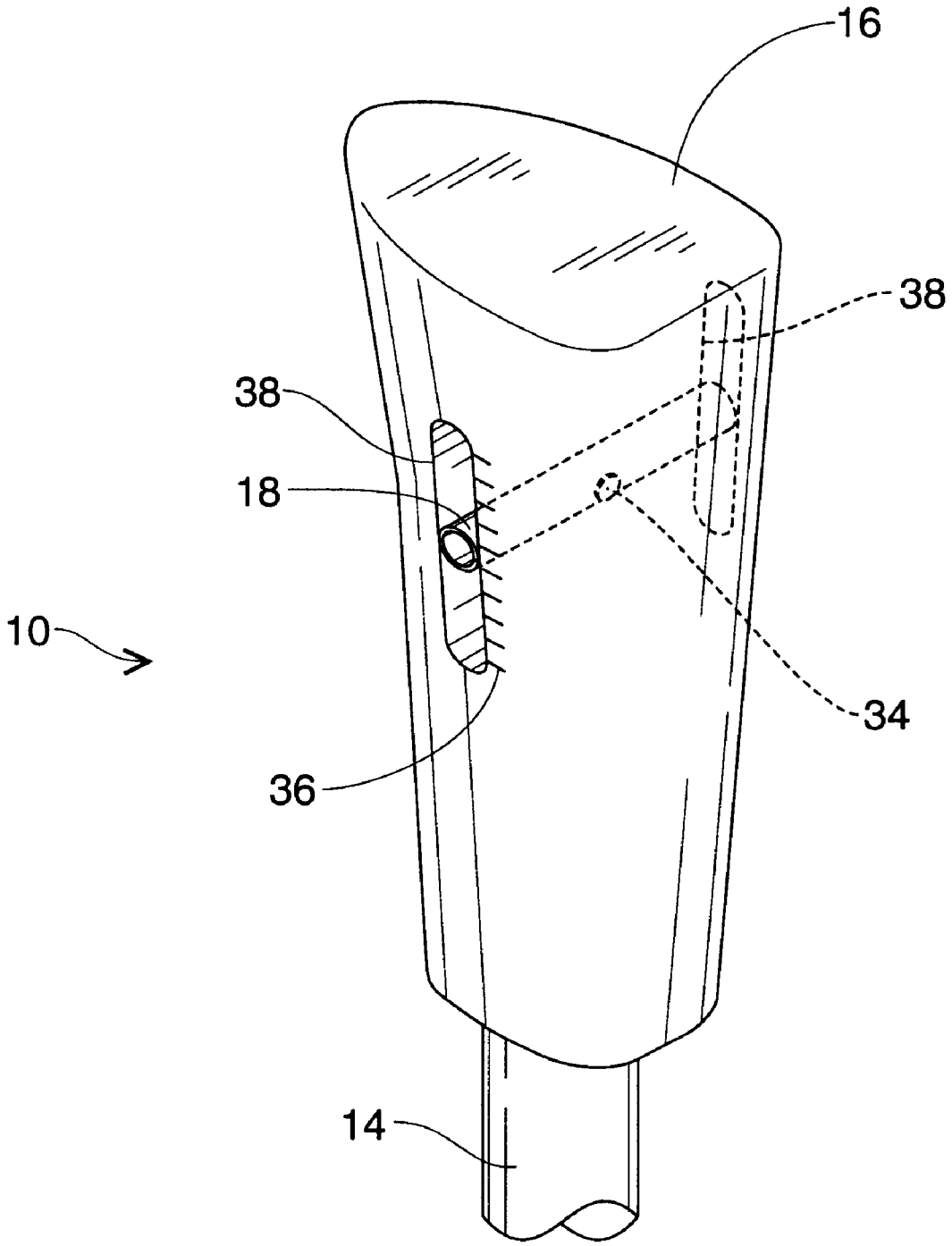
FIG. 8 is a partial perspective view of the golf putter, showing yet another embodiment.

FIG. 8 is a partial perspective view of the golf putter 10, showing another embodiment, wherein the sighting apparatus 18 is pivotally adjustable about a pivot pin 34. The pivot pin 34 is oriented perpendicularly to the shaft 14. In this embodiment, the angle of the sighting apparatus 18 can be varied so that the hole 22 can be viewed through the sighting apparatus 18 at various distances from the hole 22. The handle 16 includes elongated apertures 38 there-through, including graduated markings 36 there-along. The markings 36 can indicate the angles of the sighting apparatus 18, or can indicate distances at which a golfer can view the hole 22 when an end of the sighting apparatus 18 is aligned with a particular marking 36. In this embodiment, the pivot pin 34 may be mounted in a known manner to the shaft 14 similar to FIG. 4, to the handle 16 similar to FIG. 5, or to an adapter 30 similar to FIGS. 6 and 7.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A golf putter comprising:

a. a head;

b. a shaft;

c. a generally tubular sighting apparatus attached to the shaft such that a geometric plane containing a longitudinal axis of the sighting apparatus having a longitudinal axis of the shaft pass there-through forms a right angle with a plane containing a face of the head; and d. the sighting apparatus being held pivotal about an axis which is horizontal when the shaft is vertical.

2. The golf putter of claim 1, wherein the sighting apparatus extends through the shaft and through a handle grip which surrounds the shaft.

3. The golf putter of claim 1, wherein the sighting apparatus is disposed beyond a distal end of the shaft and extends through a handle grip which is attached to the distal end of the shaft.

4. An apparatus for aligning a golf putter with a hole, the apparatus comprising:

a. a handle having a longitudinal recess therein configured to receive a distal end of a shaft of the golf putter;

b. an adapter within the recess, the adapter comprising an insert configured to be received within the shaft;

c. the adapter having a head adapted to be positioned beyond the distal end of the shaft when the insert is received within the shaft; and d. a sighting apparatus extending generally transversely through the handle and through the head of the adapter.

5. The apparatus of claim 4, wherein the insert is generally cone shaped.

6. A generally tubular, elongated handle having an open end adapted for insertion of a distal end of a shaft of a golf club there-through such that a longitudinal axis of the shaft and a longitudinal axis of the handle are collinear, the handle comprising a sighting apparatus extending generally transversely there-through and being pivotal within a geometric plane which contains the longitudinal axis of the handle, whereby the handle is adapted to be positioned on the shaft such that the geometric plane within which the sighting apparatus is pivotal forms a right angle with a plane containing a face of a head of the golf club.

* * * * *